United States Patent [19]

Shea

[11] Patent Number: 4,905,011

[45] Date of Patent: Feb. 27, 1990

[54] CONCENTRIC RING ANTENNA

[75] Inventor: Donald F. Shea, Plano, Tex.

[73] Assignee: E-Systems, Inc., Dallas, Tex.

[21] Appl. No.: 81,962

[22] Filed: Jul. 20, 1987

[51] Int. Cl.[4] ..... H01Q 21/06; H01Q 1/36

[52] U.S. Cl. ..... 342/361; 343/895

[58] Field of Search ..... 342/361, 365; 343/895, 343/797, 799, 855, 796, 756, 742, 744

[56] References Cited

U.S. PATENT DOCUMENTS 3,949,407 4/1976 Jagdmann et al. ..... 343/895

4,320,402 3/1982 Bowen ..... 343/769

4,434,425 2/1984 Barbano ..... 343/797

*Primary Examiner*—Thomas H. Tarcza

*Assistant Examiner*—Gregory C. Issing

*Attorney, Agent, or Firm*—Gardere & Wynne

[57] ABSTRACT

A multi-element antenna formed of symmetrical paired elements symmetrically positioned in a concentric arrangement. The proximate ends of the elements are interconnected through a switching network which, when properly biased, permits exciting the element of the antenna to obtain right-hand or left-hand circularly polarized radiation.

6 Claims, 21 Drawing Sheets

TYPICAL

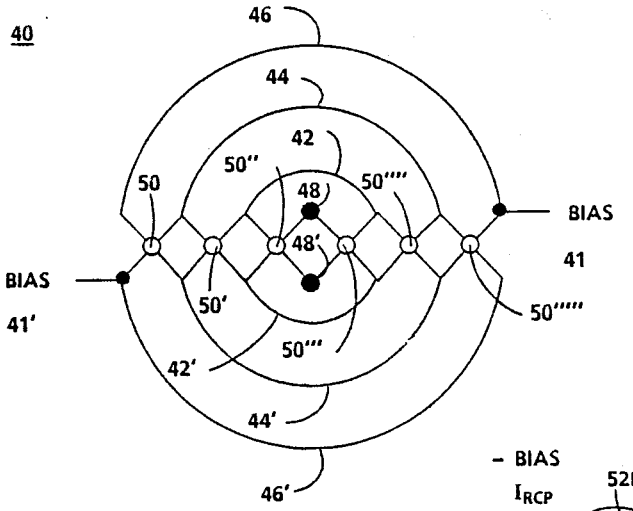
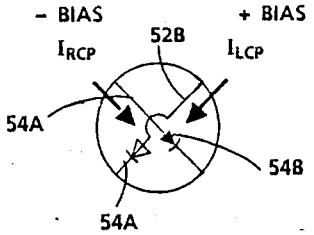
50
Fig 5C
Fig 5

151'
TYPICAL
151-155

CONCENTRIC RING ANTENNA

TECHNICAL FIELD

The present inVention relates to planar and conical antennas and more particularly to a method and apparatus for alternately providing right-hand and left-hand circular polarization from the same antenna.

BACKGROUND OF THE INVENTION

Since the late 1950's, airborne electronic warfare antenna systems have generally utilized the broadband spiral antenna, both of the planar and conical types. The virtue of these antennas are many, particularly the planar type. First, the planar is flush mountable on an aircraft skin, thereby reducing aerodynamic loading. Second, both types demonstrate excellent and near-constant electrical performance over very broad frequency ranges. Third, an array of these antennas can be made to operate autonomously as direction finders. Accordingly, these types of antennas have served well over the years. However, they possess a serious and possibly critical shortcoming in that they can only respond to one sense of circular polarization.

There has been, in recent years, strong evidence that more and more signals of interest are being circularly polarized and, are being switched during operation from one sense to the other. Thus, electronic warfare systems antennas designed for one polarization sense will be effectively blind to the oppositely polarized emitter. Currently, the only solution is the doubling of antenna assets, further increasing space and weight loading on the aircraft.

In the prior art, many attempts have been made to address the major drawback in two and four arms spiral antennas, which is that they are conventionally fed at the center of the structure, so that only one sense of circular polarization is produced. Various attempts at achieving dual circular polarization with a spiral have met without practical success. For example, one method attempts to obtain both senses of circular polarization at the same time by feeding the antenna at both ends of the spiral arms. As expected, the pattern produced by feeding the spiral at its center is satisfactory. However, feeding the spiral at the opposite ends where the arms are normally terminated leads to many problems such as spurious radiation from higher order nodes, excessive losses, poor impedance characteristics and loss of important phase and amplitude tracking qualities. Due to inherently poor performance characteristics and limited bandwidths, this configuration has been largely abandoned as a useful concept.

Another technique is directed to the use of multi-arm (six or more) configurations which use a complex feed network to produce excitations for modes higher than is normally used or desired. One version utilizing this concept generates different mode excitations at the feed points of a six arm spiral. Patterns produced by these modes are oppositely polarized from the normally used mode patterns and possess similar attributes. This approach is expensive to implement, especially for reasonable frequency bandwidths. Further, the antenna must be relatively large (6 wavelengths in circumference at the lowest operating frequency) and losses are extremely high due to the long distance the energy must travel to reach the radiation bands. Accordingly, the drawbacks of this approach are that it is too expensive, too large, too complicated, and too performance limited to have useful application.

BRIEF SUMMARY OF THE INVENTION

To overcome the limitations of the prior art, a method and apparatus is provided to permit exciting a single antenna to emit or receive either left-hand or right-hand circularly polarized radiation. This is achieved by providing a multi-element antenna which is formed by placing symmetrically arced elements in a concentric circle arrangement and interconnecting the ends of each element to the proximate ends of other elements through a switching network. Applying either a positive or a negative bias to the switching network results in the antenna being configured to permit exciting the elements to obtain a right-hand or a left-hand circularly polarized radiation in either the transmitting or receiving mode.

BRIEF DESCRIPTION OF THE DRAWINGS

FIG. 5 is a schematic diagram similar to FIG. 4 and showing the positioning of the bias switched diode pairs.

FIG. 5A' illustrates the effect of negative bias applied to the switching diodes of FIG. 5A.

FIG. 5B' illustrates the effect of positive bias applied to the switching diodes of FIG. 5B.

FIG. 6A' illustrates the effect of negative bias applied to the switching diodes of FIG. 6.

FIG. 6B' illustrates the effect of positive bias applied to the switching diodes of FIG. 6.

DETAILED DESCRIPTION

The present invention comprises a method and apparatus for alternately exciting a single antenna to either a left-hand or right-hand polarization mode. The principal of operation of the antenna is best understood by first considering the operation of the conventional broadband spiral antenna operating as an emitter.

Figure 1:
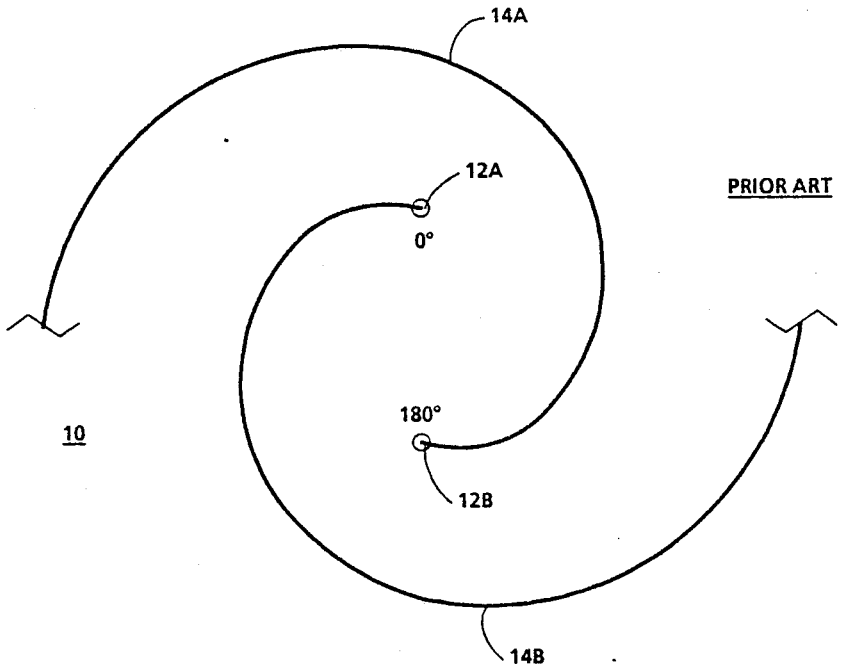
FIG. 1 shows a two port spiral antenna as disclosed in the prior art.
Figure 2A:
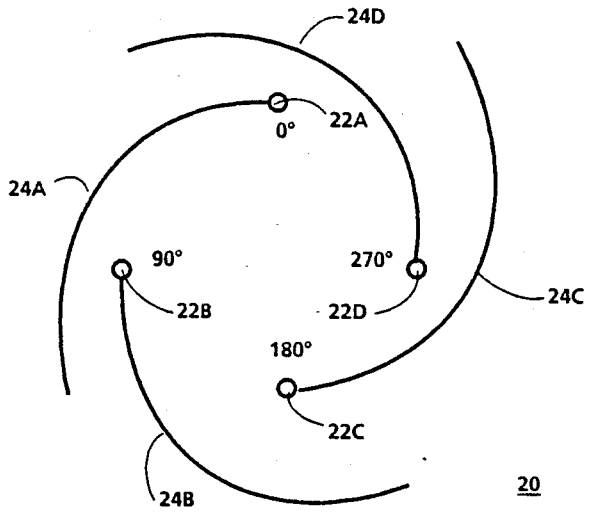
FIG. 2A shows a four port spiral antenna utilizing "sum" excitation as disclosed in the prior art.
Figure 2B:
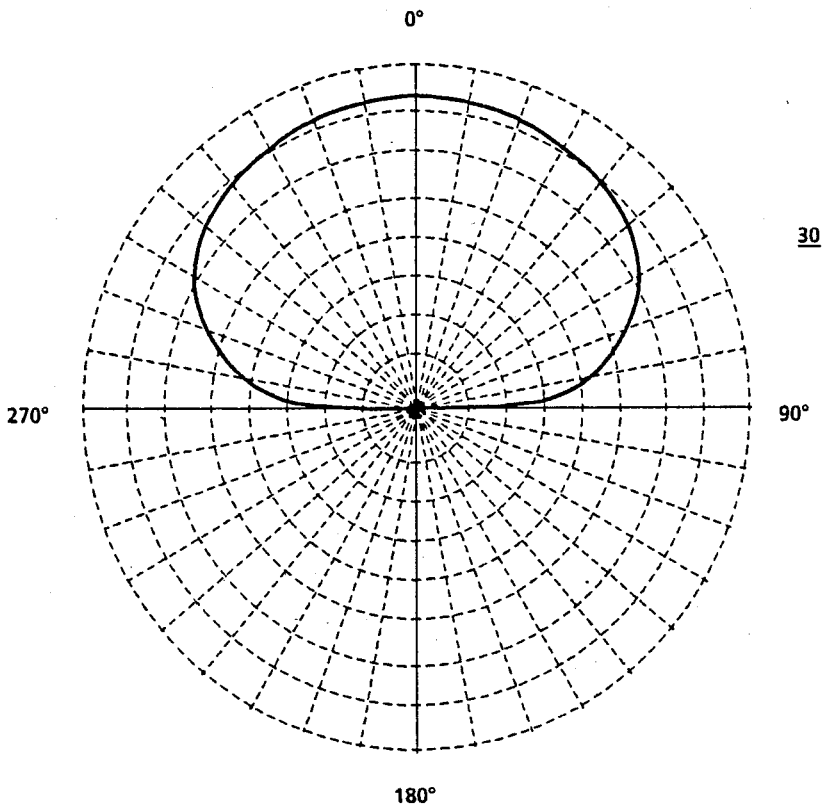
FIG. 2B shows the sum radiation pattern derived from the antenna of FIG. 2A.

Out of phase voltage excitation of the driving point terminals or feed points, 12A, 12B, of a two arm spiral antenna 10, as shown in FIG. 1, induces a traveling wave of energy in the arms of the spiral. Near the feed points, 12A, 12B, the current in adjacent arms 14, 15 is almost completely out of phase thereby containing (preventing the radiation of) the energy in a transmission line mode. As the wave progresses further away from the center of the structure, the phase gradually shifts, due to the continually increasing difference in arm 14 lengths, until the energy in adjacent arms is nearly in-phase. At this point, the energy is no longer bound and radiation begins to occur. This region of the spiral is called the radiation band and occurs when the mean circumference of the structure is approximately one wavelength. The radiation intensity is strongest along the axis of the antenna and is either left-hand or right-hand circularly polarized, depending on the wrap sense of the spiral. Any residual energy that is not radiated continues to propagate along the spiral arms alternately traveling through trapped transmission line modes and radiation modes until the energy is effectively dissipated Multi-arm spirals operate in a similar fashion, except that many modes of radiation can be produced by permutating the phase at the multiplicity of feed points available in a multi-arm configuration. That is, $(N-1)$ modes can be independently excited in an N-arm spiral. A four arm spiral antenna 20, by way of example, can generate three different pattern modes. If the four terminals 22A, 22B, 22C, 22D are phased as shown in FIG. 2A, energy travels outwardly along the arms 24A, 24B, 24C, 24D in a trapped transmission line mode until the currents in adjacent arms 24A-D are in-phase at which point the structure begins to radiate. This region is called the Mode 1 Radiation Band and it occurs when the mean circumference is approximately one wavelength. The peak of the radiated intensity occurs along the axis of the antenna 20. The radiation pattern 30 produced, shown in FIG. 2B is commonly called the "Sum" pattern.

Figure 3C:
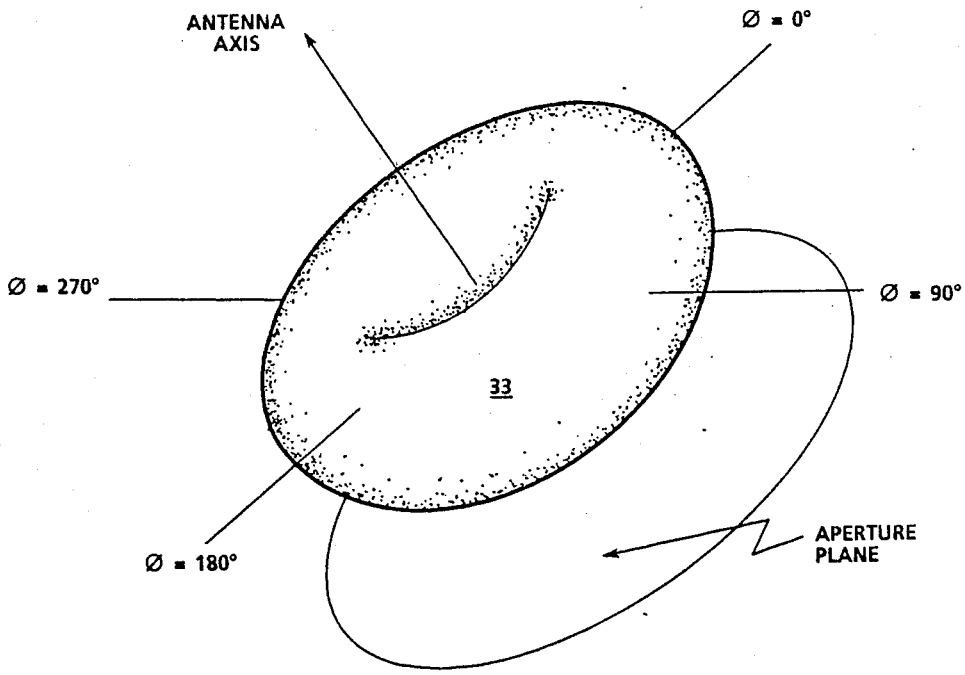
FIG. 3C shows a three dimensional representation of the radiation difference pattern obtained through "difference" excitation of the spiral antenna of FIG. 3A.
Figure 3A:
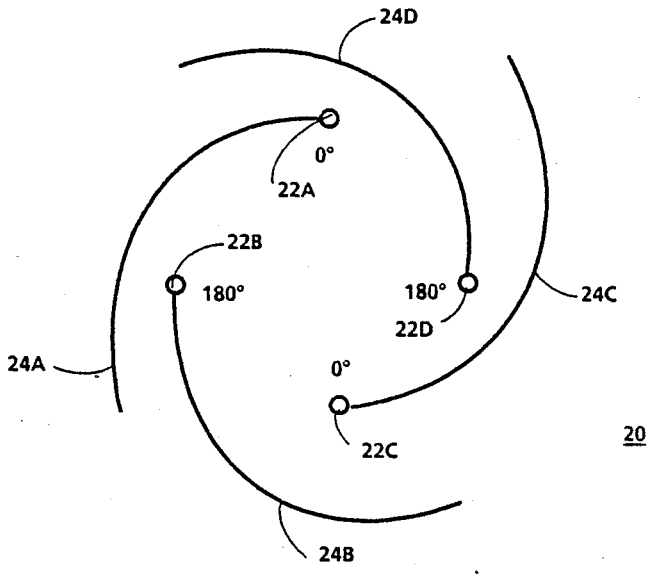
FIG. 3A shows a four arm spiral antenna utilizing "difference" excitation from the prior art.
Figure 3B:
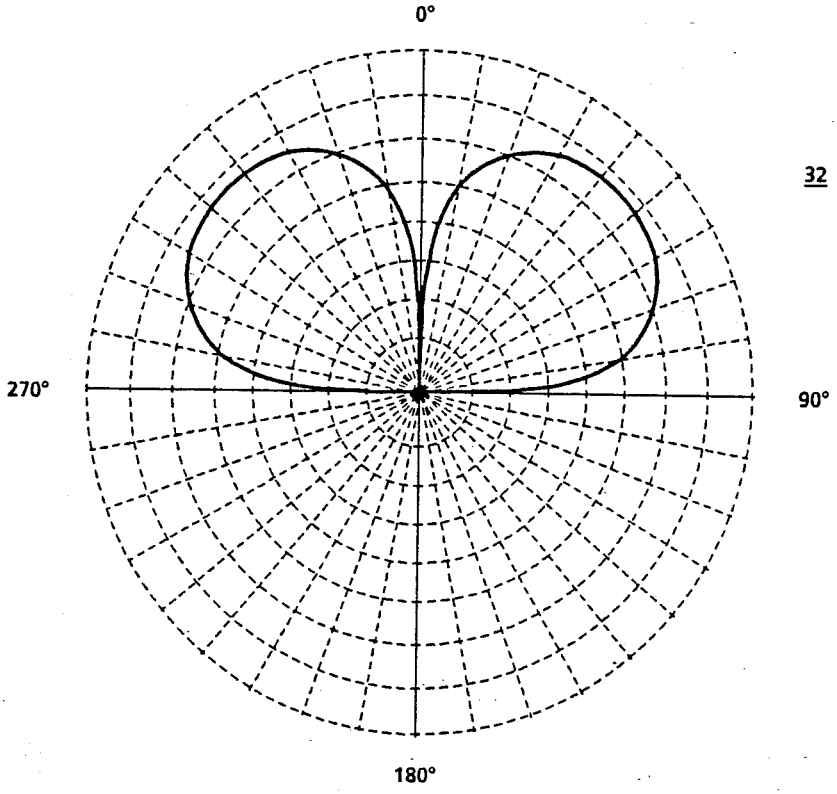
FIG. 3B shows the difference radiation pattern obtained from the antenna of FIG. 3A.

Phasing the terminals 22A-D out of the four arm spiral antenna 20 as shown in FIG. 3A does not produce in-phase conditions on adjacent arms 24A-D until the energy has traveled to a band having a mean circumference of two wavelengths. Accordingly, this region is called the Mode 2 Radiation Band. Radiation from the Mode 2 radiation band produces what is called a "Difference" pattern 32. In this case, a null or region of low radiation intensity is produced along the axis of the antenna 20, the peak occurring symmetrically about the antenna axis at a cone angle of approximately 45 degrees from the axis. The radiation pattern 32 for this mode is shown in FIG. 3B. The sum and difference patterns thus produced are circularly polarized in the same sense, the polarity being determined by the wrap direction of the antenna arms.

Although the above discussion has treated the antenna as an emitter, by reciprocity, the antenna works accordingly as a receiver. It is as a receiving antenna that the sum (Mode 1) and difference (Mode 2) pattern characteristics, shown three-dimensionally in FIGS. 2C and 3C as 31 and 33, respectively, are so useful in tracking/homing applications. Off-boresight angle information can be derived by comparing amplitudes of the relative signal level received at the Mode 1 and Mode 2 excitation ports 22A-D. Additionally, up-down and left-right information about the direction of the signals can be derived from the phase difference between the two modes. Therefore, by using both phase and amplitude information from the four arm spiral, an electronic system can be built to determine, three-dimensionally, the direction of arrival of radio frequency emissions.

The present invention provides a method and apparatus which permits the use of a single antenna for achieving sum or difference mode operation while alternately providing left-hand or right-hand circular polarization from the single antenna.

Figure 4:
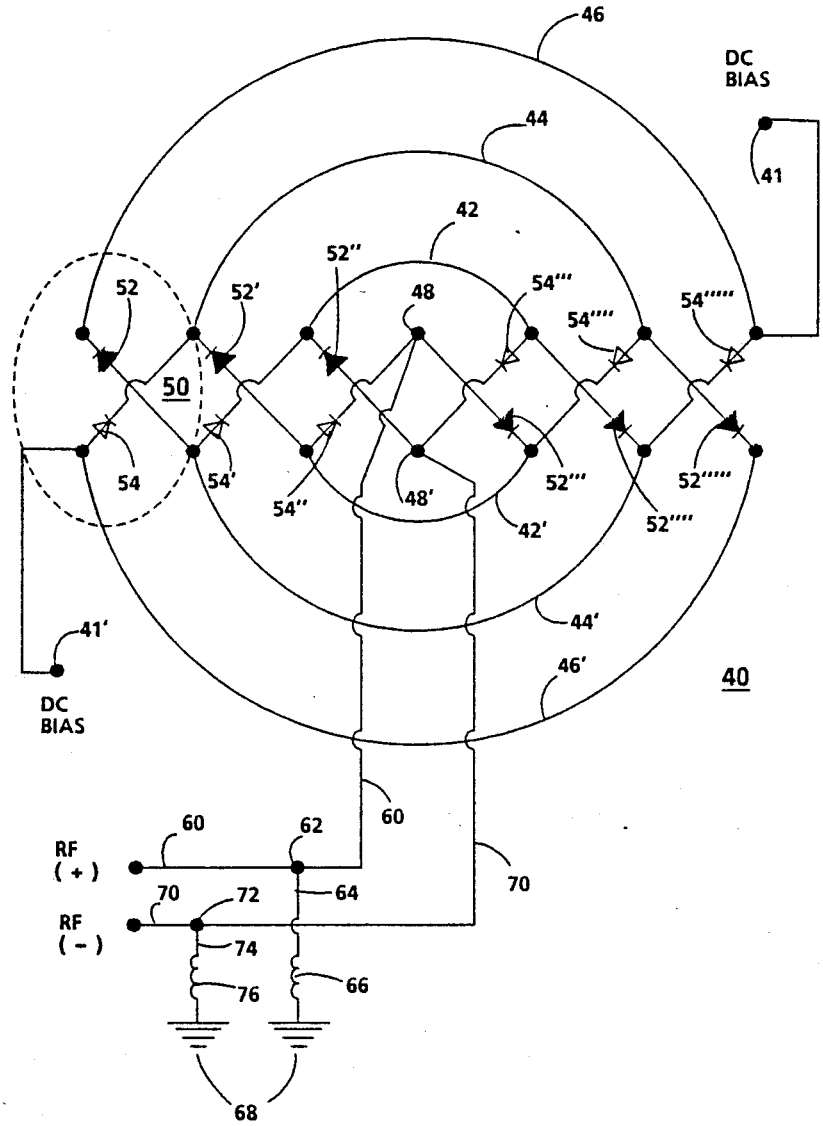
FIG. 4 is a schematic diagram showing the 2 port concentric ring antenna embodying the reversible polarization capability of the present invention.
Figure 4A:
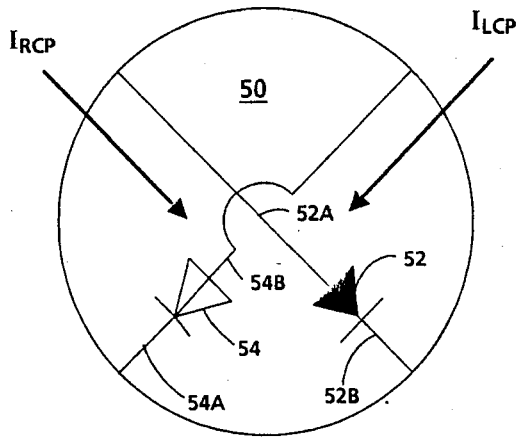
FIG. 4A is a schematic of a portion of FIG. 4 showing a typical switching diode pair as utilized in practicing the present invention.

Referring now to FIG. 4, there shown a schematic diagram of a 2 port concentric ring antenna incorporating the alternate polarization capability of the present invention. The antenna is made up of paired, symmetrical, elements such as, but not limited to arc-shaped antenna elements 42, 42' and 44, 44', and 46, 46' positioned in the concentric circular or ring arrangement shown in FIG. 4. However, it will be appreciated that the concentric elements may be of shapes other than circular arcs, dependent upon the actual radiation pattern desired. Switching elements, shown in FIG. 4 as switching diodes 52 through 52'''' and 54 through 54'''', are interconnected between the ends of opposing, different sized arc-shaped antenna elements in the following manner. The positive lead 52A, as shown in FIG. 4A for a typical paired switching diode network, of switching diode 52 is connected to one end of arc-shaped element 46. The negative lead 52B of switching diode 52 is connected to the proximate end of arc-shaped element 44'. The second switching diode 54 of the typical paired arrangement 50 as shown in FIG. 4A has the positive lead 54B of diode 54 interconnected to one extremity of arc-shaped element 46' and the negative lead 54A connected to the proximate end of arc-shaped element 44. In a like manner, switching diodes 52' through 52'''' have the positive lead of each, 52'A through 52''''A, respectively, connected to element extremities 44, 42, 42', 44', and 46', respectively.

Further the negative leads 52B' through 52B'''' of diodes 52' through 52'''', respectively, are connected to the proximate extremity of element 42, antenna feed point 48', antenna feed point 48, and proximate element extremities 42 and 44, respectively.

Similarly, the switching diodes 54' through 54'''' have their positive leads, 54B' through 54B'''' respectively, connected to one extremity of 44', 42', 42, 44, and 46 respectively. Further, the negative leads 54A' through 54A'''' of switching diodes 54' through 54'''', respectively, are connected to the proximate extremities of arc-shaped element 42, antenna feed point 48, antenna feed point 48', the proximate extremity of arc-shaped element 42' and 44', respectively.

A pair of radio frequency (RF) conductors 60 and 70 are connected to antenna feed points 48 and 48', respectively, to provide either excitation to drive the antenna as a transmitter or to retrieve signals detected by the antenna 40 when utilized as a receiver. Each line 60, 70 is balanced by inserting an impedance matching device, not shown, such as a balun between the RF source and the lines 60, 70. Each balanced RF line 60, 70 has a DC bias path to ground, having a conductor 64, 74 connected to conductor 60, 70 at junctions 62, 72, respectively. An inductor 66, 76 has one end connected to conductors 64, 74, respectively, and the remaining end to ground 68.

One such balun generally known in the art is the Marchand balun. A desirable characteristic of the Marchand balun is a built-in path to ground for the DC bias currents, removing the requirement to add such to the balanced RF feed lines.

Referring now to FIG. 5, there shown a simplified schematic diagram of the antenna of FIG. 4, depicting each of the diode pairs 52, 54 through 52''''', 54''''' as a typical diode pair element 50. It should be understood that antenna 40, incorporating the present invention, is shown utilizing three arc-shaped element pairs, 42, 42', 44, 44', and 46, 46' as a matter of convenience and not as a limitation on the number of symmetrical-pair elements that may be utilized, since the desired operational frequency of the antenna will determine the number of elements used.

During operation and referring still to FIG. 5, a direct current bias, which by way of example and not by way of limitation, might be on the order of a maximum of 20 milliamps, is applied to the bias input points 41, 41'. It should be noted that in this example, a bias identical in amplitude and polarity is applied to both points and is selected to provide the switching current necessary to turn on the switching diodes and permit conduction. The DC ground is supplied by the paths tapped off of RF lines 60, 70 at connections 52, 72 and connected by conductors 64, 74 through coils 66, 76 to ground 68. Some applications may require that different amplitude bias levels e applied to the points 41, 41' but the polarity of the bias will always be the same for both points.

Figure 5A:
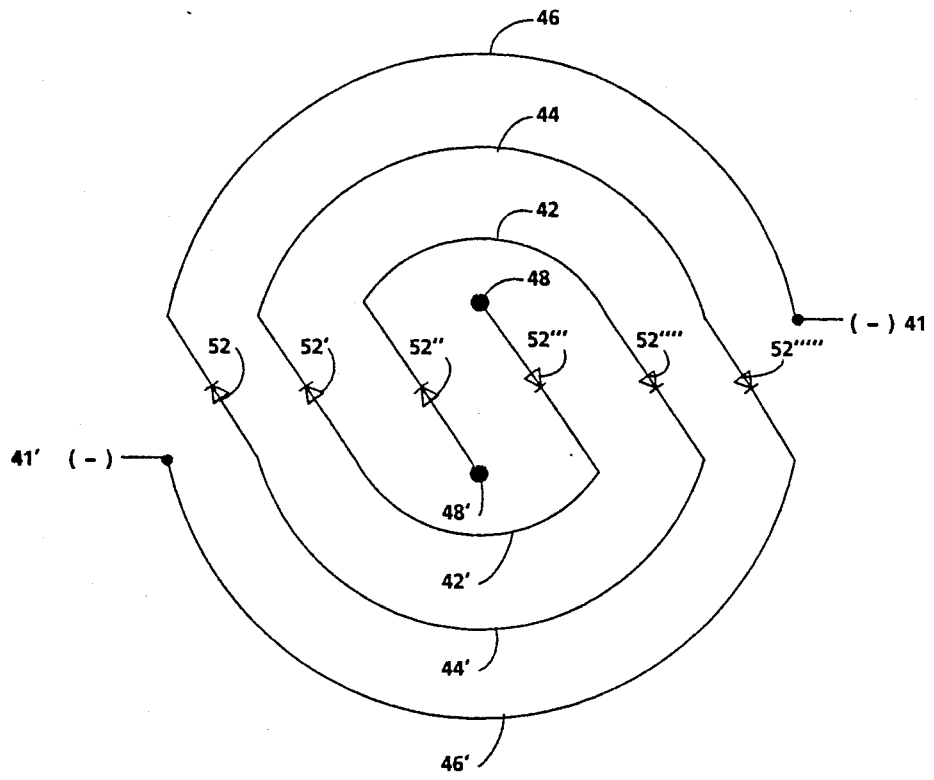
FIG. 5A AND 5B indicates the conducting diode paths when DC bias is applied to the bias input point of FIG. 5.
Figure 5A:
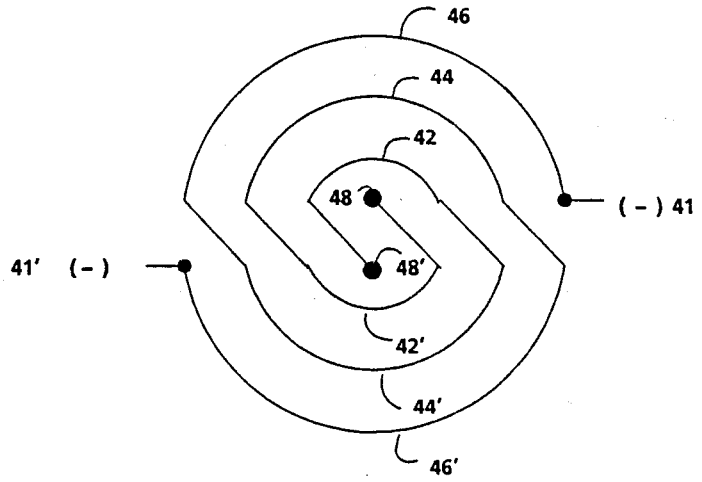

By selecting a negative DC bias to be applied to bias feed points 41, 41', and referring now to FIG. 5A, diodes 52 through 52''''' are switched on, providing paths between the feed points 48, 48' and the DC bias points 41, 41'. One such path is provided from feed point 48 through diode 52''', element 42', diode 52', element 44, diode 52''''', and element 46' to DC bias input point 41'. A second path is provided from feed point 48' through diode 52', element 42, diode 52'''', element 44', diode 52, and element 46 to DC bias input point 41.

Referring now to FIG. 5A', it is seen that applying a negative DC bias to the DC input points 41, 41' results in an antenna having an effective right-hand wrap, so that the effective polarization, either transmitting or receiving, is right circular.

Figure 5B:
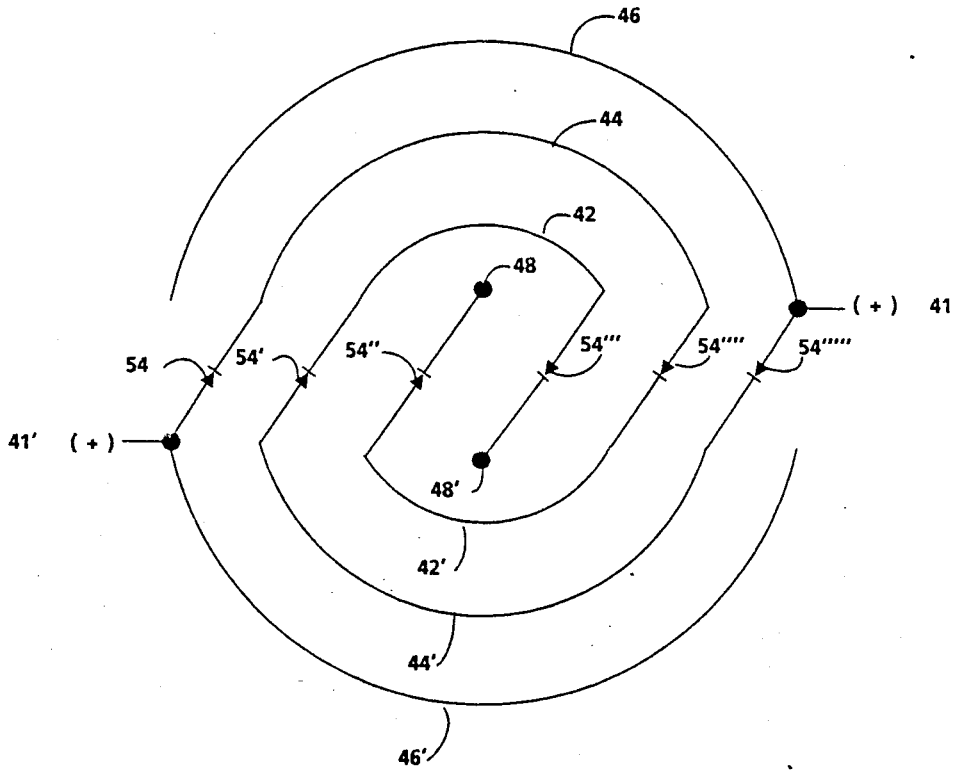
Figure 5B:
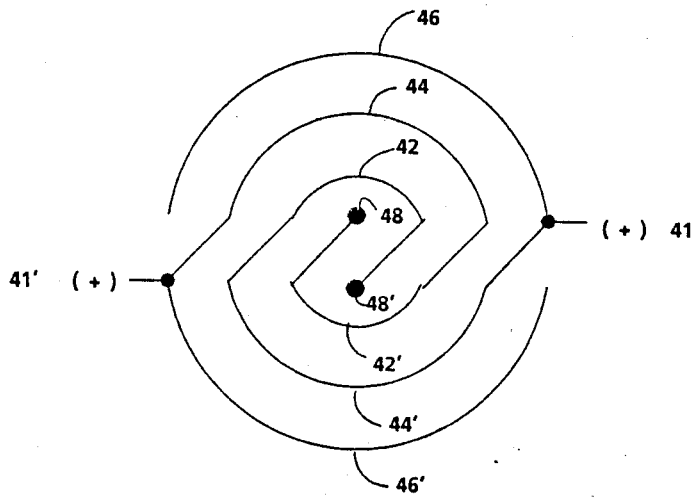

However, and referring now to FIG. 5B, the full concept of the invention becomes more apparent when the direct current bias is changed in polarity from a negative voltage to a positive voltage and applied at bias input points 41, 41'. Again, the switching current is selected to turn on the switching diodes 54 through 54'''''. Again, a current path, and referring to FIG. 4, is picked up from ground 68 through coils 66, 76, conductors 64, 74 and connected to RF lines 60, 70 at connectors 62, 72, to feed points 48, 48'. The positive bias provides one path from arc element 44 through diode 54''''', arc element 44', diode 54', element 42 and through diode 54''' to feed point 48'. A second path is provided from element 46' through diode 54, element 44, diode 54'''', element 42' and diode 54'' to feed point 48.

The resultant effective antenna is that shown in FIG. 5B', which approximates an antenna having a left-wrap sense so that either transmitting or receiving across feed points 48, 48' would emit or receive a left-circular polarized signal.

Thus it can be seen that by merely switching polarity of the bias applied to bias input points 41, 41' the antenna can be transitioned from a right circular polarization to a left-circular polarization and back with the time for change over limited by the turn on speed of the diodes incorporated into the unit. For purposes of switching speed, weight and current dissipation, a best mode embodiment is envisioned using standard pin diodes as the switching diodes incorporated into the unit. However, this is by way of illustration and not by way of limitation and it should be pointed out that other switching means in addition to pin diodes or other switching type diodes could be utilized in practicing the invention.

Further, increasing or decreasing the bias level applied at DC bias input points 41, 41' acts to vary the gain of the antenna. As the DC bias level is increased, either positively or negatively, the gain of the antenna increases or decreases in direct relation to tee change in bias level. Thus it can be seen that one advantage of the present invention is an inherent Automatic Gain Control (AGC) capability in the antenna. By reducing the DC bias to zero, the antenna can be effectively switched off, which for certain operations has advantages. The gain can then be increased in direct proportion to the increase in the DC bias level to the maximum rated input bias current of the antenna.

Figure 6:
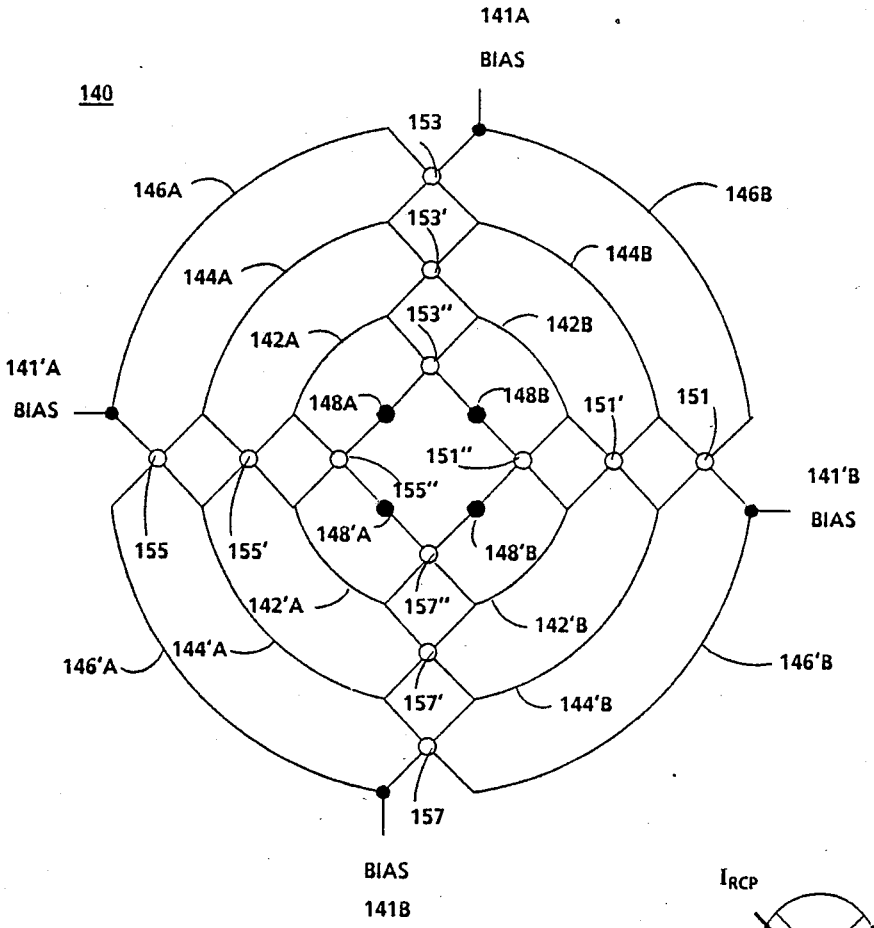
FIG. 6 is a schematic diagram similar to FIG. 5 but illustrating a 4 port concentric ring antenna embodying the present invention.
Figure 6C:
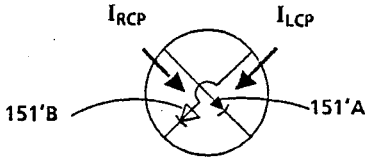
FIG. 6A AND 6B indicate the conducting diode paths when DC bias is applied to the bias input points of FIG. 6.

The preceding description has shown the applicability of the present invention to providing a 2-port, left or right circularly polarized antenna. However, it will be appreciated that a multi-port antenna having more than two ports feeding or receiving from an equal number of arms can be provided which incorporate the present invention. Referring now to FIG. 6, there shown a schematic of a four port concentric ring antenna incorporating the present invention. It will be appreciated that although shown embodying symmetrical arc-shaped elements arranged in concentric circular form as shown in FIG. 5 for a two port antenna, the depicted embodiment of the present invention is shown as a four-port antenna having concentric shaped rings formed by multiple symmetrical arc-shaped elements. In the embodiment shown in FIG. 6, there are three rings formed of four arc-shaped elements in each ring. Each ring is connected to the adjacent rings through a series of switching networks as are the concentric ring elements depicted in FIG. 5. It will be appreciated that although depicted utilizing three rings, the effective length of each arm provided by the antenna can be lengthened or shortened by the addition of additional rings or deleting existing rings as determined by the desired operating frequency range of the antenna. This effective lengthening or shortening of the antenna has a direct affect upon the frequency at which the antenna either transmits or receives. As the length is increased, that is as the number of concentric circle arc-pairs are increased, the frequency of the antenna is driven lower. Further, and as will be appreciated by those familiar with antenna design, as the number of concentric circle arc-pairs is decreased to raise the frequency, there must also be a corresponding reduction in distance between the feed points and the arc-pairs to provide the maximum increase in frequency. To provide proper operation in accordance with the concepts of the present invention, four DC bias input points 141A, 141'A, 141B and 141'B are provided. Again, as in the two port antenna previously depicted, the DC bias to be applied at the input points will be of the same polarity and of a sufficient current to energize or switch on the pin diodes shown generally at interconnections 151–151'', 153–153'', 155–155'', and 157–157''.

Figure 6A:
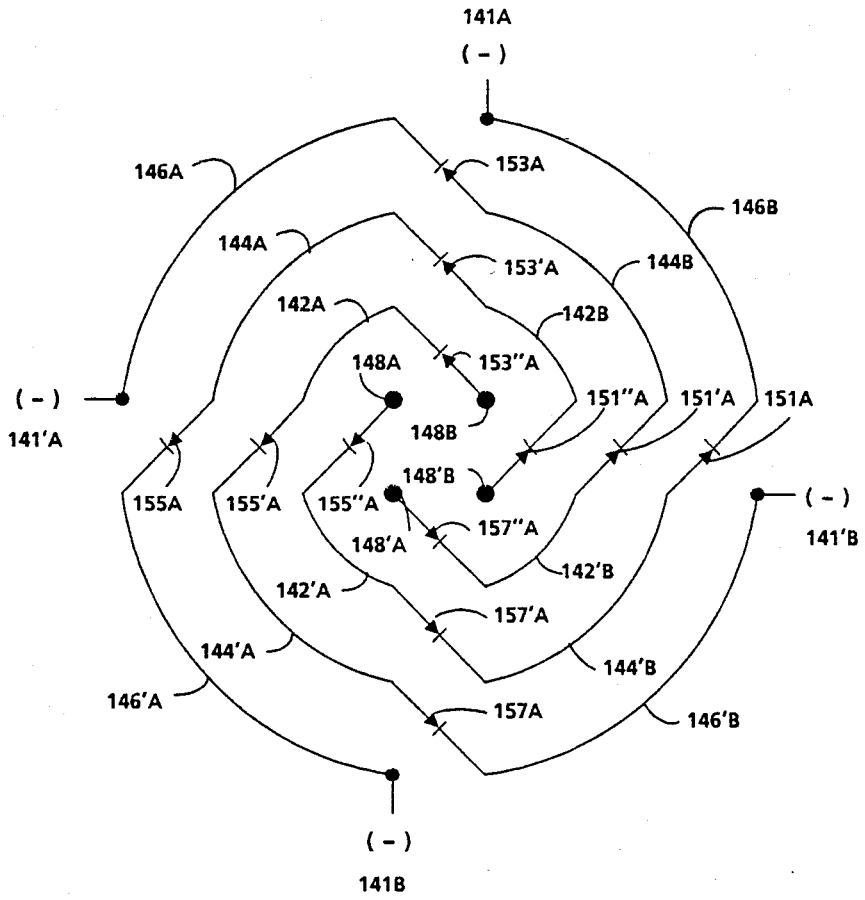
Figure 6A:
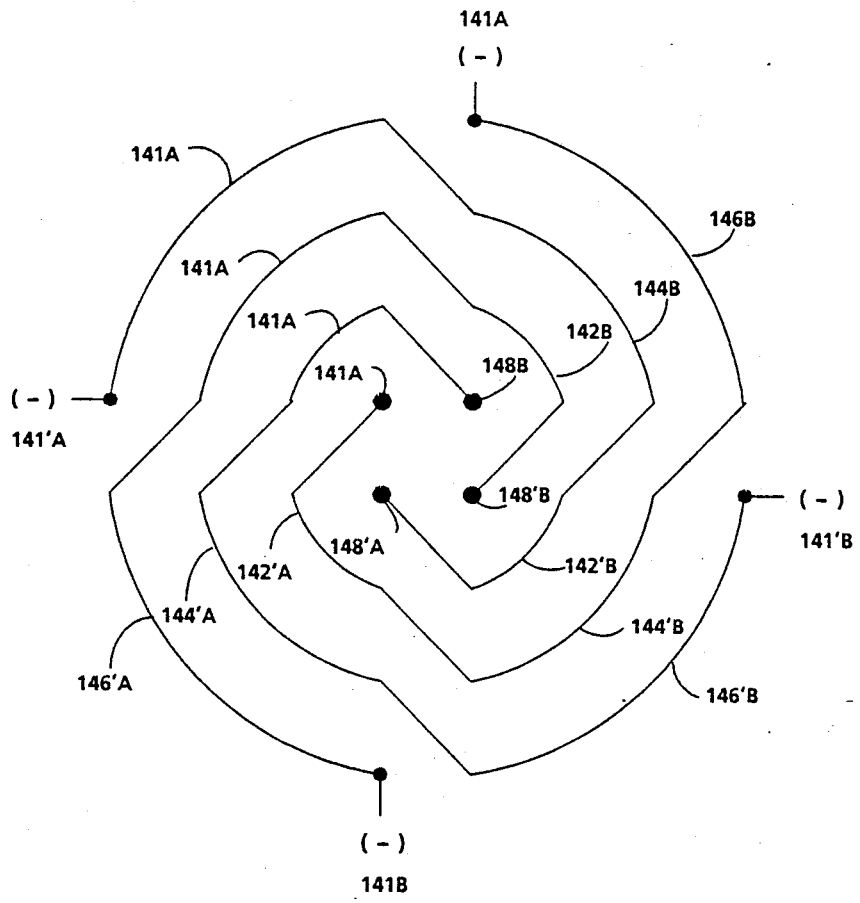

Application of a positive DC bias to the DC bias input points, and referring now to FIG. 6A, turns on the positive connected diode of each pair to provided paths from the antenna feed points 148A, 148'A, 148B and 148'B. Accordingly, a first path is provided from 141A through element 146B, diode 151A, element 144'B, diode 157'A, element 142'A and diode 155''A to feed point 148A. It should be noted that an appropriate ground path for the DC current, although not shown, is provided as it was in the embodiment shown in FIG. 3. The second path is provided from input point 141'B through element 146'B, diode 157A, element 144'A, diode 155'A, element 142A and diode 153''A to feed point 148B. A third path is provided from input point 41B through element 146'A, diode 155A, element 144A, diode 153'A, element 142B, and diode 151''A to feed point 148'B. The fourth path is provided from input point 141'A through element 146A, diode 153A, element 144B, diode 151'A, element 142'B, and diode 157''A to feed point 148'A.

Note, and referring to FIG. 6A', that the wrap sense of the antenna thus formed is a left-hand wrap, as opposed to a right-hand wrap achieved from applying the negative bias to the two pole antenna of FIG. 3 as the polarity of the installed switching diodes has been reversed from those in FIG. 4. Accordingly, when energized by a negative DC bias with the switching diodes having this polarity as shown in this configuration, the antenna will be configured to either transmit or receive radiation in a left-circular polarized mode.

Figure 6B:
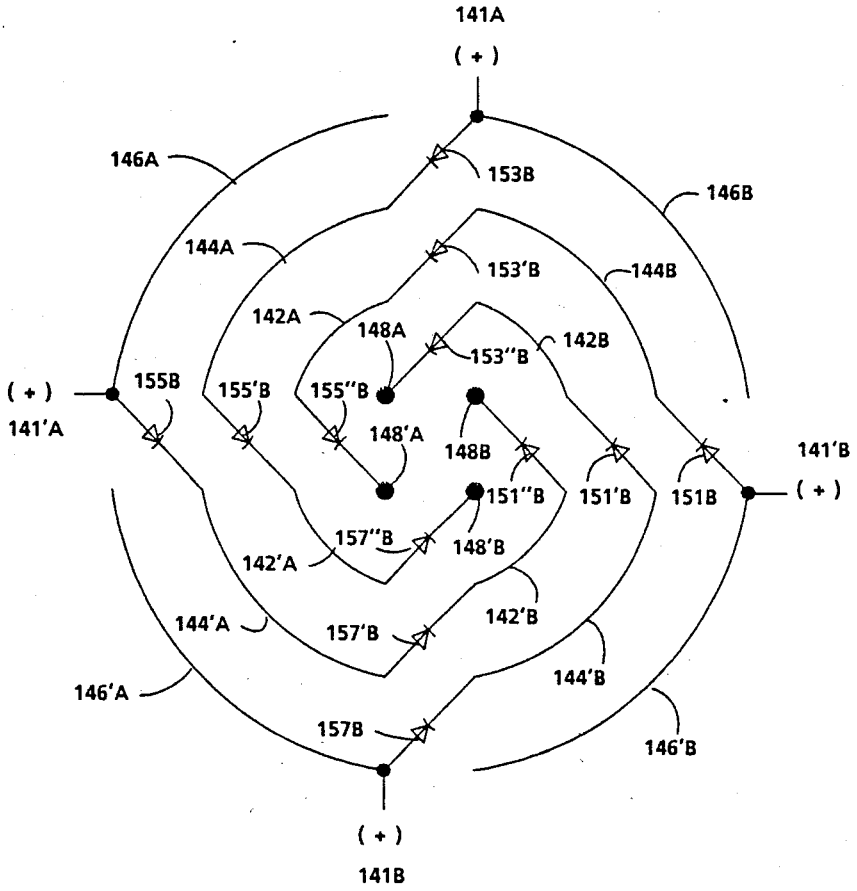
Figure 6B:
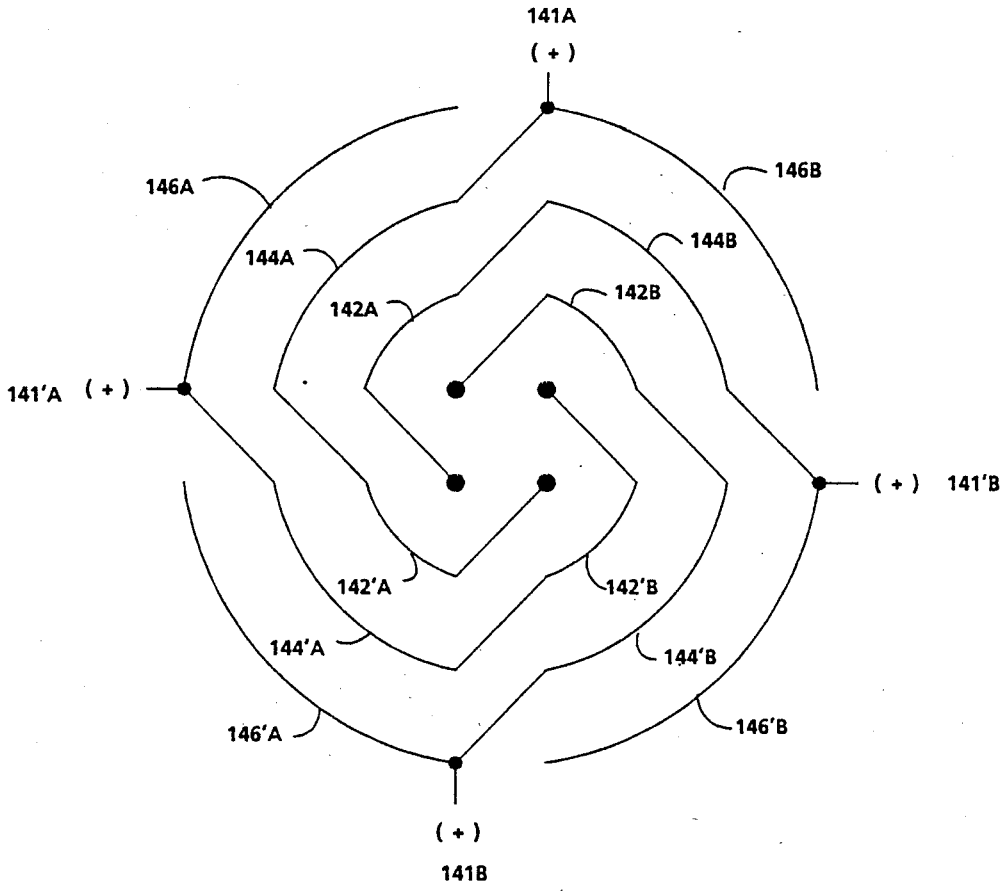

As was the case with the antenna embodiment depicted in FIG. 4, the polarization sense of the antenna depicted in FIG. 6 may be changed by reversing the polarity of the DC bias applied at the DC input points 141A, 141'A, 141B and 141'B. Referring to FIG. 6B and 6B', it will be seen that by applying a positive DC bias at the bias input points 141, 141', the diodes of each diode pair depicted in FIG. 6 which are connected to be switched on by a positive bias current will be switched on, energizing the antenna in a right wrap sense, providing a right circular polarization to the antenna for transmitting or receiving purposes.

Figure 7:
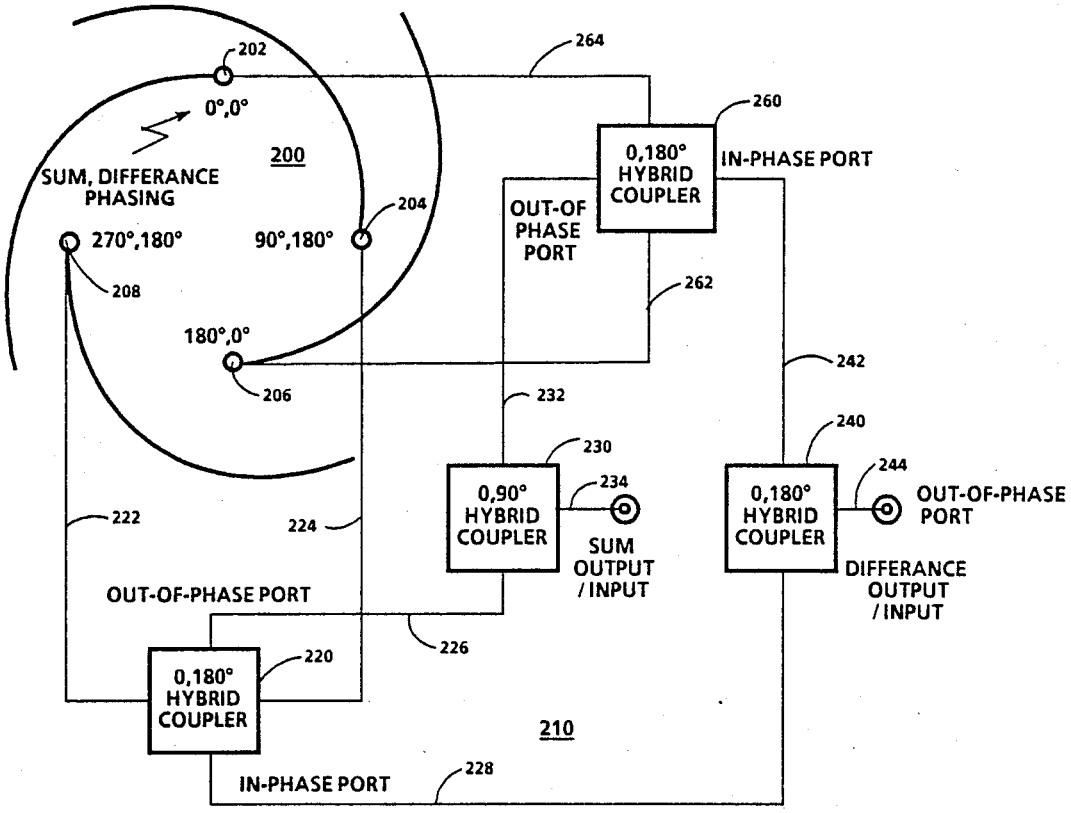
FIGURE 7 is a block diagram of a dual mode coupling network for use with a 4-port antenna incorporating the present invention.

As the above described, it is seen that a single antenna can be configured to either transmit or receive, right or left circularly polarized radiation. Referring now to FIG. 7, there shown a block diagram of a dual mode coupling network 210 capable of energizing for transmission or receiving radiation detected by a four-port antenna incorporating the present invention. The network incorporates a 0, 180° hybrid coupler 240 connected by conductor 228 to 0, 180° hybrid coupler 220 and by conductor 242 to 0, 180° hybrid coupler 260. The signals from coupler 240 are input into the end face ports of both coupler 220 and 260. Further, a 0, 90° hybrid coupler 230 is connected by conductors 226 and 232 to the outer face ports of couplers 220 and 260, respectively. Coupler 220 is connected by conductors 222 and 224 to ports 208 and 204 respectively of antenna 200, while the outputs on conductors 262 and 264 of coupler 260 are connected to antenna ports 206 and 202 respectively. It should be understood that antenna 200 is shown having a left-hand wrap as a matter of convenience only and is not by way of any limitation.

Figure 2C:
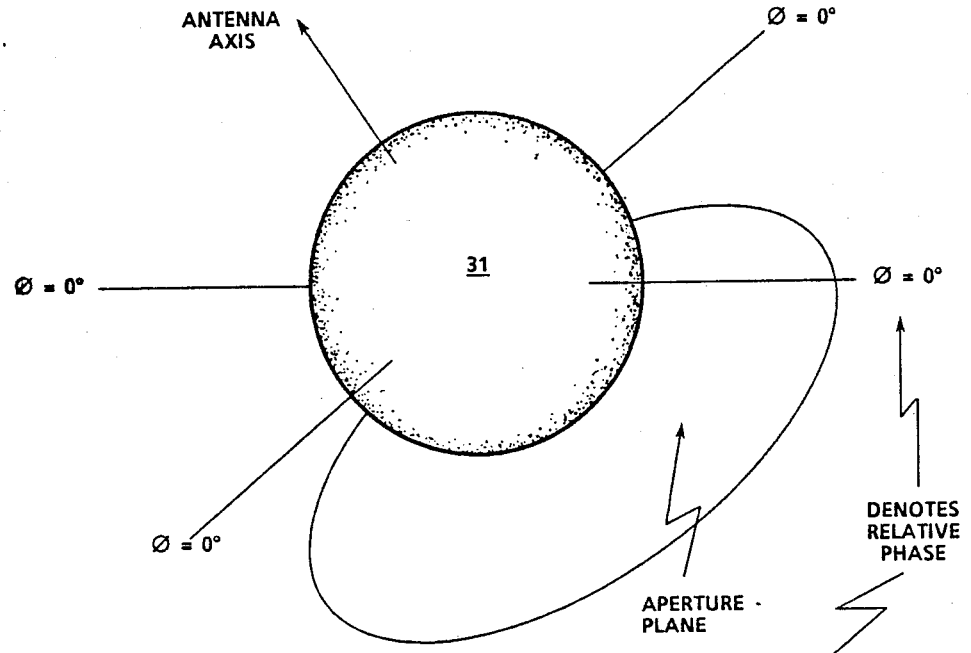
FIG. 2C shows a three dimensional representation of the radiation pattern obtained through "sum" excitation of the spiral antenna in FIG. 2A.

When configured to act as a receiving antenna, the sum output on conductor 234 from coupler 230 will be that shown in FIGS. 2B and 2C. Accordingly, the difference output is measured at the outer face port on conductor 244 connected to coupler 240 and has the pattern shown in FIG. 3B and 3C.

Conversely, driving hybrid coupler 230 with an input signal causes the sum phasing indicated on antenna 200 to be 0° at port 202, 90° at port 204, 180° at port 206 and 270° at port 208. If, however, a difference input is coupled through hybrid coupler 240, the difference phasing on antenna 200 will be 0° at port 202, 180° at port 204, 0° at port 206, and 180° at port 208.

Figure 8:
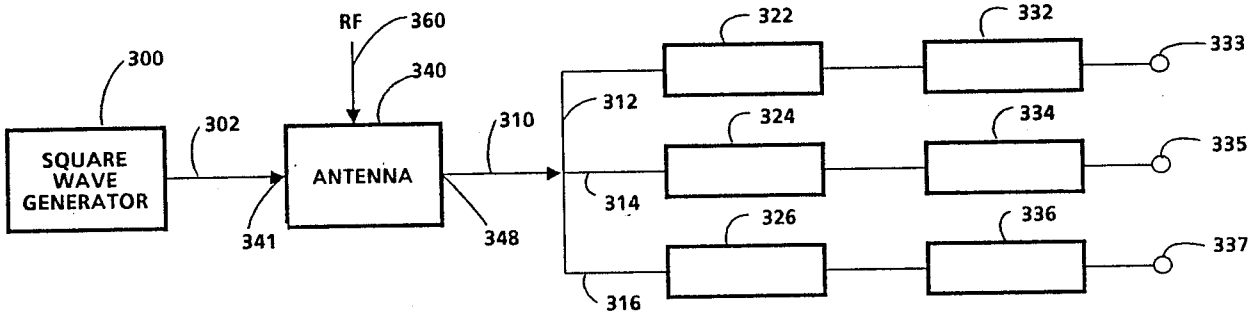
FIG. 8 is a block diagram embodying the present invention in an antenna utilized as a polarimeter.

While the above description of the invention has been directed to, among other uses, a direction finder in the like it also becomes apparent, in referring now to FIG. 8, that an antenna incorporating the present invention could be utilized in providing a polarimeter. An antenna 340 having a received RF input on 360 could be driven by a square wave of generator 300 connected to the DC bias input points 341 over conductor 302. The ports 348 of antenna 340 could be feed over conductor 310 and coupled by conductors 312, 314 and 316 through band pass filters 322, 324 and 326, respectively. By proper selection of the bandwidth of band pass filters 322 through 326, a detector 332, 334 and 336 connected to the output of 322, 324 and 326 respectively could provide information relating to the horizontal or vertical polarization of the RF signal 360 at detector outputs 333, 335 and 337. Thus, the signal passed through band pass filter 324 into detector 334 could give an indication of a vertical polarization component on output 335 while the signal through band pass filters 322 and 326 when coupled through detectors 332 and 336 respectively would give an indication of a horizontal polarization on outputs 333 and 337 due to the presence of sidebands at the detectors 332, 336.

Figure 9:
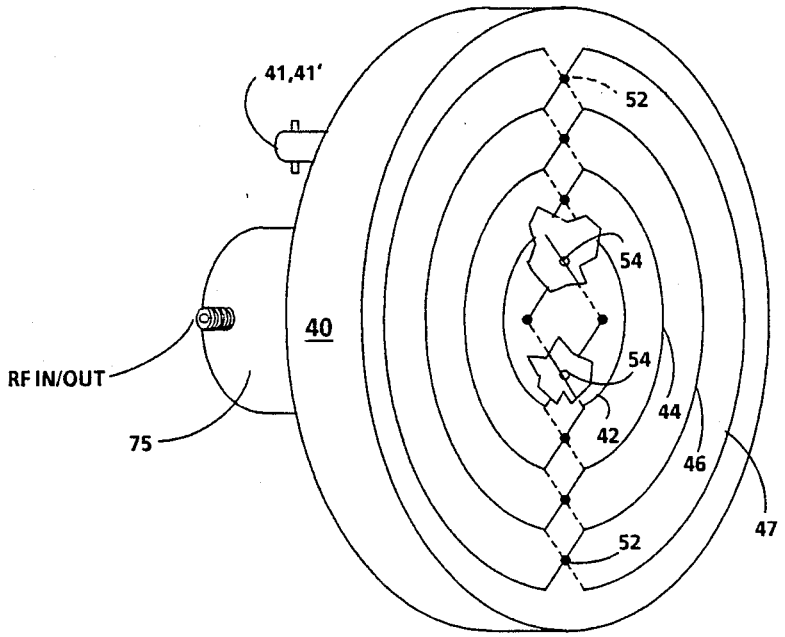
FIG. 9 is an isometric view of a concentric ring planar antenna embodying the present invention.

Referring now to FIG. 9, there shown a isometric view of a planar antenna 40 embodying the present invention. Although depicted as a planar antenna, it will be appreciated that the antenna may be constructed as a conical or similar type antenna. Further, although shown with symmetrical arc-shaped antenna elements 42, 46, 48 and 49, it will be appreciated that the antenna elements may be of different symmetrical-pair shapes. As depicted, the symmetrical arc-shaped antenna element pairs 42, 44, 46 and 49, are interconnected through switching diodes, shown typically at 52, 54. In one method of construction, as shown in FIG. 9, it is envisioned that one set of similarly biased switching diodes such as depicted as 52, would be mounted on a surface of the planar antenna while a second, oppositely biased set of switching diodes would be mounted on the reverse surface as shown through the cut aways at 54. As shown, the RF input output is fed into a balun 75, such as the Marchand balun which has been previously discussed, and which provides a path to ground for the DC bias inputs on connector 41, 41'. Again, FIG. 9 merely depicts one method and shape of construction of an antenna embodying the present invention which provides a single antenna which can be switched from one mode of circular polarization, either left-hand or right-hand, to the opposite mode of circular polarization.

It also becomes apparent that the present invention is directed to providing a multi-use single antenna which can be used to replace the arrays presently required to perform the same function as the single antenna embodying the present invention.

Although the invention has been described in detail, it should be appreciated that the same is by way of illustration and example only and is not meant to be limiting, the spirit and scope of the invention being limited only by the terms of the appended claims.

I claim:

1. A broadband antenna comprising:

a first plurality of symmetrical paired antenna elements, positioned in a first circularly spaced relationship, each element having a first and a second end with the first and second ends of each of said elements proximate to the second and first ends respectively of adjacent elements in the circularly spaced relationship;

at least a second plurality of symmetrical paired antenna elements positioned in a second circularly spaced relationship and in a concentric spaced relationship with said first plurality of elements, each element having a first end and a second end with the first and second ends of each of said elements proximate to the second and first ends respectively of adjacent elements in the second spaced relationship and proximate to the second and first ends of adjacent elements in the concentrically spaced first plurality of elements;

a plurality of first switching means, each capable of being energized from an off state to an on state whereby a conducting path is formed through the switching means, each of the first switching means interconnected between the first end of one of the antenna elements in said first circularly spaced relationship and the second end of the proximate antenna element in the concentrically spaced second plurality of elements;

a plurality of second switching means identical to said first switching means, each interconnected between the first end of one of the antenna elements in said second circularly spaced relationship and the second end of the proximate antenna element in the concentrically spaced first plurality of elements; and means for an energizing said first switching means into a conducting or on state and each of said second switching means to non-conducting or off state, said energizing means alternately capable of energizing each of said second switching means to an on state and each of said first switching means to an off state, wherein energizing one of said first or second switching means to an on state determines the polarization of the antenna.

2. The antenna described in claim 1 wherein the first and second switching means are switching diodes capable of being energized to a conducting state by application of a bias current.

3. The antenna as described in claim 2 wherein said energizing means provides either a first or a second DC current for energizing said switching diodes to a conducting state.

4. The energizing means as described in claim 3 wherein said first DC current has a polarity preselected to energize said antenna in a first circular polarized mode.

5. The energizing means as described in claim 4 wherein said second DC current has a reversed polarity from said preselected polarity of said first DC current to energize said antenna in a second circular polarization mode.

6. The energizing means as described in claim 3 further including means for varying the amplitude of said first and second DC currents.

* * * * *